US005837939A

United States Patent [19]

Cieloszyk et al.

[11] Patent Number: 5,837,939

[45] Date of Patent: Nov. 17, 1998

[54] TREE RESISTANT CABLE

[75] Inventors: Gary S. Cieloszyk, Somerville; Jinder Jow, Branchburg, both of N.J.

[73] Assignee: Union Carbide Chemicals & Plastics Technology Corporation, Danbury, Conn.

[21] Appl. No.: 733,689

[22] Filed: Oct. 17, 1996

[51] Int. Cl.[6] ..... H01B 7/28

[52] U.S. Cl. ..... 174/110 PM; 428/379

[58] Field of Search ..... 174/110 R, 110 PM, 174/110 SR; 428/375, 378, 379, 395

[56] References Cited

U.S. PATENT DOCUMENTS

| | | | |
|---|---|---|---|
| 4,263,158 | 4/1981 | Ashcraft et al. | 252/573 |
| 4,894,284 | 1/1990 | Yamanouchi et al. | 174/110 PM X |
| 4,988,783 | 1/1991 | Beran et al. | 526/129 |
| 4,997,713 | 3/1991 | Koehnlein et al. | 174/110 PM X |
| 5,180,889 | 1/1993 | Rogers et al. | 174/110 SR X |
| 5,246,783 | 9/1993 | Spenadel et al. | 174/110 R X |
| 5,346,961 | 9/1994 | Shaw et al. | 525/281 |

OTHER PUBLICATIONS

Fujikura Cable Works K.K, Abstract of Japanese Patent Application 198,168, 1989 Derwent Publication 89–096221/13, published Feb. 15, 1989.

Raharimalala et al, "Influence of Polymer Morphology . . . ", I EEE Transactions etc., vol. 1, No. 6, Dec. 1994, pp. 1094 to 1103.

*Primary Examiner*—Kristine L. Kincaid
*Assistant Examiner*—Chau N. Nguyen
*Attorney, Agent, or Firm*—Saul R. Bresch

[57] ABSTRACT

A cable having one or more electrical conductors or a core of electrical conductors, each electrical conductor or core being surrounded by an insulating composition, essentially free from water tree growth inhibitors, having (i) a polyethylene having a density in the range of 0.860 to 0.940 gram per cubic centimeter; and, based on 100 parts by weight of component (i), (ii) about 0.2 to about 1 part by weight of a homopolymer of propylene with the proviso that the insulating composition is extruded at a temperature below the melting point of the homopolymer of propylene.

8 Claims, No Drawings

TREE RESISTANT CABLE

TECHNICAL FIELD

This invention relates to electric power cable insulated with a polyethylene composition having resistance to water trees.

BACKGROUND INFORMATION

A typical electric power cable generally comprises one or more conductors in a cable core surrounded by several layers of polymeric material that include a first semiconducting shield layer, an insulating layer, a second semiconducting shield layer, a metallic tape or wire shield, and a jacket.

These insulated cables are known to suffer from shortened life when installed in an environment where the insulation is exposed to water, e.g., underground or locations of high humidity. The shortened life has been attributed to the formation of water trees, which occur when an organic polymeric material is subjected to an electrical field over a long period of time in the presence of water in liquid or vapor form. The net result is a reduction in the dielectric strength of the insulation.

Many solutions have been proposed for increasing the resistance of organic insulating materials to degradation by water treeing. One solution involves the addition of polyethylene glycol, as a water tree growth inhibitor, to a heterogeneous low density polyethylene such as described in U.S. Pat. Nos. 4,305,849; 4,612,139; and 4,812, 505. Generally, however, morphological modifications of polyethylene without water tree growth inhibitors have been elusive. One such method involves the use of a homogeneous polyethylene per se as the organic insulating material. See U.S. Pat. No. 5,246,783. A technique, which would be useful with both homogeneous and heterogeneous polyethylenes and also avoids the use of water tree inhibiting compounds, would be advantageous. Morphological modifications are desirable because they avoid the use of compounds, which might affect the properties of the base polyethylene. Thus, there is a continuous industrial demand for novel modifications of this type.

DISCLOSURE OF THE INVENTION

An object of this invention, therefore, is to provide an insulated cable which exhibits resistance to water trees, and is based on a morphologically modified polyethylene. Other objects and advantages will become apparent hereinafter.

According to the invention, an insulated cable has been discovered which meets the above object.

The cable comprises one or more electrical conductors or a core of electrical conductors, each electrical conductor or core being surrounded by an insulating composition, essentially free from any water tree growth inhibitors, comprising (i) a polyethylene having a density in the range of 0.860 to 0.940 gram per cubic centimeter; and, based on 100 parts by weight of component (i)

(ii) about 0.2 to about 1 part by weight of a homopolymer of propylene with the proviso that the insulating composition is extruded at a temperature below the melting point of the homopolymer of propylene.

In another embodiment of the invention, a process for extrusion has been discovered comprising the following steps:

(i) providing one or more electrical conductors or a core of electrical conductors and an insulating composition comprising polyethylene having a density in the range of 0.860 to 0.940 gram per cubic centimeter, said insulating composition being essentially free from any water tree growth inhibitors;

(ii) introducing the components of step (i) into an extruder;

(iii) admixing about 0.2 to about 1 part by weight of a homopolymer of propylene per 100 parts by weight of polyethylene with the polyethylene prior to or during step (ii); and (iv) extruding the mixture around the electrical conductor or core at a temperature below the melting point of the homopolymer of propylene.

DESCRIPTION OF THE PREFERRED EMBODIMENT(S)

Polyethylene, as that term is used herein, is a homopolymer of ethylene or a copolymer of ethylene and a minor proportion of one or more alpha-olefins having 3 to 12 carbon atoms, and preferably 4 to 8 carbon atoms, and, optionally, a diene, or a mixture of such homopolymers and copolymers. The mixture can be a mechanical blend or an in situ blend. Examples of the alpha-olefins are propylene, 1-butene, 1-hexene, 4-methyl-1-pentene, and 1-octene.

The polyethylene can be homogeneous or heterogeneous. The homogeneous polyethylenes usually have a polydispersity (Mw/Mn) in the range of about 1.5 to about 3.5 and an essentially uniform comonomer distribution, and are characterized by single and relatively low DSC melting points. The heterogeneous polyethylenes, on the other hand, have a polydispersity (Mw/Mn) greater than 3.5 and do not have a uniform comonomer distribution. Mw is defined as weight average molecular weight and Mn is defined as number average molecular weight. The polyethylenes of interest here can have a density in the range of 0.860 to 0.940 gram per cubic centimeter, and preferably have a density in the range of 0.870 to about 0.930 gram per cubic centimeter. They also can have a melt index in the range of about 0.5 to about 30 grams per 10 minutes, and preferably have a melt index in the range of about 1 to about 6 grams per 10 minutes.

The polyethylenes can be produced by low or high pressure processes. They are preferably produced in the gas phase, but they can also be produced in the liquid phase in solutions or slurries by conventional techniques. Low pressure processes are typically run at pressures below 1000 psi whereas high pressure processes are typically run at pressures above 15,000 psi. Typical catalyst systems, which can be used to prepare these polyethylenes, are magnesium/titanium based catalyst systems, which can be exemplified by the catalyst system described in U.S. Pat. No. 4,302,565 (heterogeneous polyethylenes); vanadium based catalyst systems such as those described in U.S. Pat. Nos. 4,508,842 (heterogeneous polyethylenes) and 5,332,793; 5,342,907; and 5,410,003 (homogeneous polyethylenes); a chromium based catalyst system such as that described in U.S. Pat. No. 4,101,445; a metallocene catalyst system such as that described in U.S. Pat. Nos. 4,937,299 and 5,317,036 (homogeneous polyethylenes); or other transition metal catalyst systems. Many of these catalyst systems are often referred to as Ziegler-Natta catalyst systems. Catalyst systems, which use chromium or molybdenum oxides on silica-alumina supports, are also useful. Typical processes for preparing the polyethylenes are also described in the aforementioned patents. Typical in situ polyethylene blends and processes and catalyst systems for providing same are described in U.S. Pat. Nos. 5,371,145 and 5,405,901. The various polyethylenes can include low density homopolymers of ethylene (made by high pressure processes), linear low density polyethylenes, very low density polyethylenes, and medium density polyethylenes. The latter three polyethylenes are generally made by low pressure processes. A conventional high pressure process is described in Introduction to Polymer Chemistry, Stille, Wiley and Sons, New York, 1962, pages 149 to 151.

The homopolymers of propylene can be produced, for example by the process disclosed in U.S. Pat. No. 5,093,415. More particularly, it was found that polymers having an isotactic index of at least 96 percent could be prepared in high yield at high production rates by polymerizing propylene in a low pressure, gas phase fluidized bed process at temperatures in excess of 50° C. employing a catalyst system comprising (i) a solid catalyst precursor, which includes magnesium, titanium, halogen, and an inside electron donor, i.e., a polycarboxylic acid ester containing two coplanar ester groups attached to adjacent carbon atoms; (ii) a hydrocarbylaluminum cocatalyst; and (iii) an outside electron donor or selectivity control agent, i.e., a silicon compound containing a silicon-oxygen-carbon linkage wherein the atomic ratio of aluminum to silicon is in the range of about 0.5:1 to about 100:1 and the atomic ratio of aluminum to titanium is in the range of about 5:1 to about 300:1. The high activity at temperatures in the range of about 50° C. to about 110° C. makes this catalyst system and similar catalyst systems using mono- and polycarboxylic acid esters as the inside and outside electron donors such as those mentioned in U.S. Pat. Nos. 4,414,132 and 4,882,380 very attractive. The polypropylene can also be made using many of the catalysts mentioned above for the production of polyethylene. The homopolymer is preferably a fast crystallization grade. It can have a density in the range of 0.890 to 0.906 gram per cubic centimeter, and preferably has a density of 0.900 to 0.902 gram per cubic centimeter, and a flow index in the range of about 2 to about 35 grams per 10 minutes, and preferably about 15 to about 25 grams per 10 minutes.

The insulating composition, the polyethylene, and the propylene homopolymer used in this invention are essentially free of those compounds, which act as water tree growth inhibitors. For each 100 parts by weight of polyethylene, there are about 0.2 to about 1 part by weight of propylene homopolymer, and preferably about 0.3 to about 0.7 part by weight propylene homopolymer.

Conventional additives, which can be introduced into the polyethylene formulation, are exemplified by antioxidants, coupling agents, ultraviolet absorbers or stabilizers, antistatic agents, pigments, dyes, reinforcing fillers or polymer additives, slip agents, plasticizers, processing aids, lubricants, viscosity control agents, tackifiers, anti-blocking agents, surfactants, extender oils, metal deactivators, voltage stabilizers, flame retardant fillers and additives, crosslinking agents, boosters, and catalysts, and smoke suppressants. Fillers and additives can be added in amounts ranging from less than about 0.1 to more than about 200 parts by weight for each 100 parts by weight of the base resin, in this case, polyethylene. Additives are generally added in amounts of about 0.1 to about 5 parts by weight, and fillers are generally added in much larger amounts, e.g., about 50 to about 200 parts by weight.

Examples of antioxidants are: hindered phenols such as tetrakis[methylene(3,5-di-tert-butyl-4-hydroxyhydrocinnamate)]methane, bis[(beta-(3,5-ditert-butyl-4-hydroxybenzyl)-methylcarboxyethyl)]sulphide, 4,4'-thiobis (2-methyl-6-tert-butylphenol), 4, 4'-thiobis(2-tert-butyl-5-methylphenol), 2,2'-thiobis(4-methyl-6-tert-butylphenol), and thiodiethylene bis(3,5-di-tert-butyl-4-hydroxy) hydrocinnamate; phosphites and phosphonites such as tris (2,4-di-tert-butylphenyl)phosphite and di-tert-butylphenylhosphonite; thio compounds such as dilaurylthiodipropionate, dimyristylthiodipropionate, and distearylthiodipropionate; various siloxanes; and various amines such as polymerized 2,2,4-trimethyl-1,2-dihydroquinoline. Antioxidants can be used in amounts of about 0.1 to about 5 parts by weight per 100 parts by weight of polyethylene.

The resin can be crosslinked by adding a crosslinking agent to the composition or by making the resin hydrolyzable, which is accomplished by adding hydrolyzable groups such as —$Si(OR)_3$ wherein R is a hydrocarbyl radical to the resin structure through copolymerization or grafting.

Suitable crosslinking agents are organic peroxides such as dicumyl peroxide; 2,5-dimethyl- 2,5-di(t-butylperoxy) hexane; t-butyl cumyl peroxide; and 2,5-dimethyl-2,5-di(t-butylperoxy)hexane-3. Dicumyl peroxide is preferred. The organic peroxides are usually added in an amount of about 1 to about 2 parts by weight per 100 parts by weight of polyethylene.

Hydrolyzable groups can be added, for example, by copolymerizing ethylene with an ethylenically unsaturated compound having one or more —$Si(OR)_3$ groups such as vinyltrimethoxy-silane, vinyltriethoxysilane, and gamma-methacryloxypropyltrimethoxysilane or grafting these silane compounds to the resin in the presence of the aforementioned organic peroxides. The hydrolyzable resins are then crosslinked by moisture in the presence of a silanol condensation catalyst such as dibutyltin dilaurate, dioctyltin maleate, dibutyltin diacetate, stannous acetate, lead naphthenate, and zinc caprylate. Dibutyltin dilaurate is preferred.

Examples of hydrolyzable copolymers and hydrolyzable grafted copolymers are ethylene/vinyltrimethoxy silane copolymer, ethylene/gamma-methacryloxypropyltrimethoxy silane copolymer, vinyltrimethoxy silane grafted linear low density ethylene/1-butene copolymer, and vinyltrimethoxy silane grafted high pressure low density polyethylene.

The cable of the invention can be prepared in various types of extruders, e.g., single or twin screw types. Compounding can be effected in the extruder or prior to extrusion in a conventional mixer such as a Brabender™ mixer or a Banbury™ mixer. When compounding is effected prior to extrusion, the compounding can be conducted at temperatures at or above the melting point of the propylene homopolymer, if desired. For the purposes of this specification, the term "extruded" is intended to include, in addition to conventional extrusion, other processes for fabricating the cable including, for example, injection molding, blow molding, and compression molding. It will be understood, then, that the homopolymer of propylene is not to be exposed to temperatures at or above its melting point during the fabrication of the insulating layer of the cable.

A description of a conventional extruder can be found in U.S. Pat. No. 4,857,600. A typical extruder has a hopper at its upstream end and a die at its downstream end. The hopper feeds into a barrel, which contains a screw. At the downstream end, between the end of the screw and the die, is a screen pack and a breaker plate. The screw portion of the extruder is considered to be divided up into three sections, the feed section, the compression section, and the metering section, and two zones, the back heat zone and the front heat zone, the sections and zones running from upstream to downstream. In the alternative, there can be multiple heating zones (more than two) along the axis running from upstream to downstream. If it has more than one barrel, the barrels are connected in series. The length to diameter ratio of each barrel is in the range of about 15:1 to about 30:1. Provided that the temperature is below the melting point of the homopolymer of propylene, extrusion can be carried out at temperatures in the range of about 110 to about 155 degrees C, and are preferably carried out at temperatures in the range of about 110 to about 145 degrees C. In wire coating, where the material is crosslinked after extrusion, the die of the crosshead feeds directly into a heating zone, and this zone can be maintained at a temperature in the range of about 130° C. to about 260° C., and preferably in the range of about 170° C. to about 220° C. Thus, after fabrication, crosslinking can be effected at temperatures at or higher than the melting point of the propylene homopolymer.

The advantage of the invention lies in the improved water tree growth rate over the polyethylene per se. It is theorized that the propylene homopolymer acts as a nucleating agent to reduce spherulite sizes thus causing a morphological modification of the polyethylene.

The patents mentioned in this specification are incorporated by reference herein.

The invention is illustrated by the following examples.

EXAMPLES 1 to 12

The water tree growth test used here is described in U.S. Pat. No. 4,263,158. The object is to measure the length of the water tree resulting from the exposure of each polymer composition to moisture. Measurement is in fractions of a millimeter with an allowance made for errors in measurement. The lengths of the water trees are then compared, the polymer composition having the shortest water tree being the most advantageous.

The polymers tested are as follows:

PI is a low density heterogeneous ethylene homopolymer made by a conventional high pressure process. It has a density of 0.92 gram per cubic centimeter and a melt index of 2 grams per 10 minutes.

PII is a very low density heterogeneous polyethylene made by a conventional low pressure process. It has a density of 0.905 gram per cubic centimeter and a melt index of 4 grams per 10 minutes.

PP is a homopolymer of propylene. It is characterized as a fast crystallization grade, and has a melting point of 175 degrees C. The PP has a density of 0.900 gram per cubic centimeter and a flow index of 20 grams per 10 minutes. When used, the PP is compounded with PI or PII in an amount of 0.5 part by weight per 100 parts by weight of PI or PII in a two roll mill at 193 degrees C. The polymer composition will be referred to as PI/PP or PII/PP.

In certain examples, the polymers are crosslinked with 1.8 parts by weight dicumyl peroxide at an extrusion temperature of 155 degrees C. These polymers are designated XL.

In certain examples, a tree retardant is added to the polymer. retardant is polyethylene glycol, and it is added in an amount of 0.6 part by weight. These polymers are designated TR.

In all cases, parts by weight are based on 100 parts by weight of polyethylene.

The variables and results are set forth in the following Table.

TABLE

| Examples | Polymer Composition | Extrusion Temp (°C.) | Spherulite size (microns) | Crystallinity (%) | Tree Length (millimeter) |
|---|---|---|---|---|---|
| 1 | PI | 155 | about 1.9 | 40 | 0.43 ± 0.05 |
| 2 | PI/PP | 155 | less than 0.31 | 39 | 0.33 ± 0.09 |
| 3 | PI/PP | 185 | about 1.7 | 39 | 0.45 ± 0.06 |
| 4 | PII | 155 | about 9 | 26 | 0.27 ± 0.05 |
| 5 | PII/PP | 155 | about 3 | 25 | 0.18 ± 0.02 |
| 6 | PII/PP | 185 | about 8 to 9 | 25 | 0.26 ± 0.07 |
| 7 | XL PI | 155 | — | — | 0.57 ± 0.10 |
| 8 | XL PI/PP | 155 | — | — | 0.42 ± 0.09 |
| 9 | TR PI | 155 | — | — | 0.19 ± 0.03 |
| 10 | TR PI/PP | 155 | — | — | 0.18 ± 0.03 |
| 11 | XL TR PI | 155 | — | — | 0.23 ± 0.05 |
| 12 | XL TR PI/PP | 155 | — | — | 0.23 ± 0.09 |

We claim:

1. A cable comprising one or more electrical conductors or a core of electrical conductors, each electrical conductor or core being surrounded by an insulating composition, essentially free from any water tree growth inhibitors, comprising (i) a polyethylene having a density in the range of 0.860 to 0.940 gram per cubic centimeter; and, based on 100 parts by weight of component (i), (ii) about 0.2 to about 1 part by weight of a homopolymer of propylene with the proviso that the insulating composition is extruded at a temperature below the melting point of the homopolymer of propylene.

2. The cable defined in claim 1 wherein the polyethylene is a copolymer of ethylene, at least one alpha-olefin, and, optionally, a diene.

3. The cable defined in claim 1 wherein the polyethylene has a melt index in the range of about 0.5 to about 30 grams per 10 minutes.

4. The cable defined in claim 2 wherein the alpha-olefin is 1-butene, 1-hexene, 4-methyl-1-pentene, or 1-octene.

5. The cable defined in claim 1 wherein the extrusion temperature is in the range of about 110 to about 145 degrees C.

6. The cable defined in claim 1 wherein the polyethylene is crosslinked in the presence of an organic peroxide with the further proviso that, prior to crosslinking, the insulating composition is extruded at a temperature below the decomposition temperature of the organic peroxide.

7. The cable defined in claim 1 wherein the propylene homopolymer has a density in the range of 0.890 to 0.906 gram per cubic centimeter and a flow index in the range of about 2 to about 35 grams per 10 minutes.

8. A cable comprising one or more electrical conductors or a core of electrical conductors, each electrical conductor or core being surrounded by an organic peroxide crosslinked insulating composition, essentially free from water tree growth inhibitors, comprising (i) a polyethylene having a density in the range of 0.870 to 0.930 gram per cubic centimeter and a melt index in the range of about 1 to about 6 grams per 10 minutes; and, based on 100 parts by weight of component (i), (ii) about 0.3 to about 0.7 part by weight of a homopolymer of propylene having a density in the range of 0.900 to 0.902 gram per cubic centimeter and a flow index in the range of about 15 to about 25 grams per 10 minutes with the proviso that the insulating composition is extruded at a temperature in the range of about 110 to about 155 degrees C, but below the melting point of the homopolymer of propylene and, prior to crosslinking, below the decomposition temperature of the organic peroxide.

* * * * *